US011143476B2

(12) United States Patent
Schneider

(10) Patent No.: US 11,143,476 B2
(45) Date of Patent: Oct. 12, 2021

(54) RECOIL INTENSIFIER OF AN EXTERNALLY POWERED MACHINE WEAPON, IN PARTICULAR A MACHINE GUN

(71) Applicant: RHEINMETALL WAFFE MUNITION GMBH, Unterluess (DE)

(72) Inventor: Hubert Schneider, Dietingen (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 0 days.

(21) Appl. No.: 15/867,414

(22) Filed: Jan. 10, 2018

(65) Prior Publication Data

US 2018/0231343 A1 Aug. 16, 2018

Related U.S. Application Data

(63) Continuation of application No. PCT/EP2016/065847, filed on Jul. 5, 2016.

(30) Foreign Application Priority Data

Jul. 10, 2015 (DE) ..... 10 2015 008 799.1

(51) Int. Cl.
*F41A 21/26* (2006.01)
*F41A 7/00* (2006.01)
(Continued)

(52) U.S. Cl.
CPC ..... *F41A 21/26* (2013.01); *F41A 7/00* (2013.01); *F41A 19/01* (2013.01); *F41A 25/12* (2013.01);
(Continued)

(58) Field of Classification Search
CPC ..... F41A 21/26; F41A 21/06; F41A 33/06; F41A 19/01; F41A 25/12
See application file for complete search history.

(56) References Cited

U.S. PATENT DOCUMENTS 2,146,185 A * 2/1939 Holek ..... F41A 3/10 89/152
2,152,947 A * 4/1939 Blomerius ..... F41A 19/01 200/33 R
(Continued)

FOREIGN PATENT DOCUMENTS

AT 247422 B 10/1967
AT 257422 B 10/1967
(Continued)

*Primary Examiner* — Benjamin P Lee
(74) *Attorney, Agent, or Firm* — Muncy, Geissler, Olds & Lowe, P.C.

(57) ABSTRACT

For an externally powered weapon, in particular a machine weapon and a machine gun, having at least one barrel, a recoil intensifier at the front end of the barrel is proposed to intensify a weapon return of the returning masses of the weapon and to generate and intensify a signal for monitoring, in particular functionally monitoring, the weapon. The recoil intensifier is of a flared form. The signal intensified by the intensification is used for example for counting the number of shots fired, initiating an emergency stop function, etc. Depending on the further use, the mechanically intensified signal may be converted into an electrical signal.

17 Claims, 1 Drawing Sheet

(51) Int. Cl.

| | |
|---|---|
| ***F41A 19/01*** | (2006.01) |
| ***F41A 25/12*** | (2006.01) |
| *F41A 17/18* | (2006.01) |
| *F41F 1/08* | (2006.01) |
| *F41A 21/06* | (2006.01) |

(52) U.S. Cl.
CPC ..... *F41A 17/18* (2013.01); *F41A 21/06* (2013.01); *F41F 1/08* (2013.01)

(56) References Cited

U.S. PATENT DOCUMENTS

| | | | | | |
|---|---|---|---|---|---|
| 2,362,996 | A * | 11/1944 | Green | F41A 21/26 | 89/14.3 |
| 2,459,141 | A * | 1/1949 | Balleisen | F41A 5/08 | 89/169 |
| 2,557,134 | A * | 6/1951 | Mudespacher | F41A 3/54 | 89/177 |
| 2,685,822 | A * | 8/1954 | Walton | F16F 7/116 | 89/44.01 |
| 3,363,509 | A * | 1/1968 | Tschoepe | F41A 21/26 | 89/14.5 |
| 3,369,453 | A | 2/1968 | Menneking et al. | | |
| 3,669,453 | A | 6/1972 | Du Bois et al. | | |
| 3,710,683 | A | 1/1973 | Kaltmann | | |
| 3,930,433 | A * | 1/1976 | Minaire | F41A 3/56 | 89/169 |
| 3,938,422 | A * | 2/1976 | Tellie | F41A 3/38 | 89/169 |
| 4,194,304 | A * | 3/1980 | Wolcott | F41A 33/06 | 434/18 |
| 4,481,859 | A * | 11/1984 | Dix | F41A 17/18 | 89/12 |
| 5,140,893 | A * | 8/1992 | Leiter | F41A 21/26 | 89/14.5 |
| 5,155,292 | A * | 10/1992 | Rostcil | F41A 3/82 | 89/167 |
| 5,566,486 | A * | 10/1996 | Brinkley | F41A 19/01 | 42/1.02 |
| 6,643,968 | B2 * | 11/2003 | Glock | F41A 19/01 | 42/1.02 |
| 7,100,437 | B2 * | 9/2006 | Johnson | F41A 19/01 | 73/167 |
| 7,669,356 | B2 * | 3/2010 | Joannes | F41A 19/01 | 42/1.01 |
| 8,413,565 | B2 | 4/2013 | Herrmann et al. | | |
| 8,418,388 | B2 * | 4/2013 | Ferrarini | F41A 19/01 | 42/1.03 |
| 8,616,112 | B2 | 12/2013 | Herrmann et al. | | |
| 8,726,779 | B2 | 5/2014 | Buhl et al. | | |
| 9,146,069 | B2 * | 9/2015 | Monti | F41A 33/06 | |
| 2005/0034596 | A1 * | 2/2005 | Fleming | F41A 3/68 | 89/138 |
| 2011/0072703 | A1 * | 3/2011 | Ferrarini | F41A 19/01 | 42/1.01 |
| 2014/0173963 | A1 * | 6/2014 | Kent | F41A 21/26 | 42/90 |

FOREIGN PATENT DOCUMENTS

| | | | | |
|---|---|---|---|---|
| DE | 00C0000020MAZ | | 8/1950 | |
| DE | 1839167 | U | 10/1961 | |
| DE | 1952901 | A1 | 5/1971 | |
| DE | 1953539 | A1 | 5/1971 | |
| DE | 3914600 | A1 * | 11/1990 | F41A 21/26 |
| DE | 10 2007 048 468 | A1 | 4/2009 | |
| DE | 10 2008 015 892 | B3 | 10/2009 | |
| DE | 10 2008 060 216 | A1 | 6/2010 | |
| DE | 10 2008 060 217 | A1 | 6/2010 | |
| DE | 20 2008 000 357 | U1 | 12/2010 | |
| DE | 10 2009 056 253 | B3 | 5/2011 | |
| DE | 10 2009 056 735 | A1 | 6/2011 | |
| EP | 0118814 | A2 | 9/1984 | |
| EP | 2518430 | A2 | 10/2012 | |
| GB | 235863 | A * | 2/1926 | F41A 21/26 |
| WO | WO 91/16590 | A1 | 10/1991 | |

* cited by examiner

RECOIL INTENSIFIER OF AN EXTERNALLY POWERED MACHINE WEAPON, IN PARTICULAR A MACHINE GUN

This nonprovisional application is a continuation of International Application No. PCT/EP2016/065847, which was filed on Jul. 5, 2016, and which claims priority to German Patent Application No. 10 2015 008 799.1, which was filed in Germany on Jul. 10, 2015, and which are both herein incorporated by reference.

BACKGROUND OF THE INVENTION

Field of the Invention

The present invention relates to a recoil intensifier of an externally powered weapon, in particular a machine weapon and a machine gun.

Description of the Background Art

In the case of machine weapons or machine guns, a distinction is made between self-powered weapons and externally powered weapons. In the case of self-powered weapons, the gas pressure is used for unlocking a breech action and the loading operation is initiated. In the case of externally powered weapons, the locking and unlocking of the breech as such is performed with the aid of an electrical drive.

An automatic gas-operated action for a gun is disclosed by DE 20 2008 000 357 U1, and a gas-operated action is disclosed by DE 00C0000020MAZ. As a functional enhancement, it is proposed in DE 1 839 167 U to provide a recoil intensifier in a weapon that is used for firing blank cartridges. Furthermore, a muzzle brake with a flash damper for automatic weapons and guns, with which the opening of the breech is actuated by the barrel being made to recoil by the gas pressure, is described by DE 1 953 539 A1, which corresponds to U.S. Pat. No. 3,710,683. A recoil-operated automatic gun is disclosed by AT 257 422 B, which corresponds to U.S. Pat. No. 3,369,453, while DE 10 2009 056 253 B3 presents a rebound block for a locking slide of a breech of a gas-operated action.

Externally powered weapons are known from DE 10 2009 056 735 A1 (which corresponds to U.S. Pat. No. 8,726,779), DE 10 2008 015 892 B3, DE 10 2007 048 468 A1 and DE 10 2008 060 217 A1 (which corresponds to U.S. Pat. No. 8,616,112). In the case of such weapons, a return of the weapon can be used to detect a shot as such, as disclosed in DE 10 2008 060 216 A1. When a shot has been fired, a slide is displaced from one position into another, whereas, when a shot has not been fired, it remains in the first position. Consequently, the slide cannot be carried along by a cam of the drive and the breech functionally connected to the slide cannot be unlocked. A muzzle brake on the barrel of the weapon in the case of externally driven weapons serves to minimize the return of the weapon.

SUMMARY OF THE INVENTION

It is therefore an object to provide a possible way in which not only an emergency stop but also follow-up functions for safety and/or the function of an externally powered weapon can be initiated.

In an exemplary embodiment, the invention is based on the idea of generating a sufficiently good and reproducible signal for the dependable functional detection of an externally powered machine gun, in particular in the case of a weapon with a small return.

The idea is implemented by the incorporation of a recoil intensifier instead of an otherwise used device for reducing recoil, for example a muzzle brake. The form of the recoil intensifier is funnel-shaped. As a result of the simple funnel shape, a greater return of the barrel of the weapon is produced. This intensified return of the barrel generates a more dependable signal, for example for shot detection and follow-up functions of an externally powered weapon (also machine guns). Follow-up functions are for example fault detection, quick-stop initiation and also a barrel change to be performed for example temperature-dependently. If, for example, a predeterminable shooting load is determined, for example by way of a shot counter (EP 2 518 430 A2, which is incorporated herein by reference), a change of the barrel of the weapon may be performed. In the case of a multiple-barrel weapon with a barrel cluster, having a number of barrels, a new barrel may be placed (turned) in front of the breech.

The increased recoil can be compensated by an internal return damping device, which has the effect that a small force acts on a carrier system of the weapon, without however reducing the return of the weapon itself. This may preferably be constituted by two maintenance-free return dampers at the center of gravity of the returning masses. Such a return damper may be formed by a spiral in the housing. The freedom from maintenance is a result of the closed, modular construction. The two return dampers are for their part placed in a clearance in the weapon cradle and to some extent arrested. The cradle, which is fixed in place with respect to the weapon housing (a component part of the returning mass) ensures that there is no increased shooting loading on other components, such as the motor, sensors, aiming devices and/or additional units, and a feeder that is fixed in place with respect to the weapon housing ensures that no vibrations are exerted on the munition.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
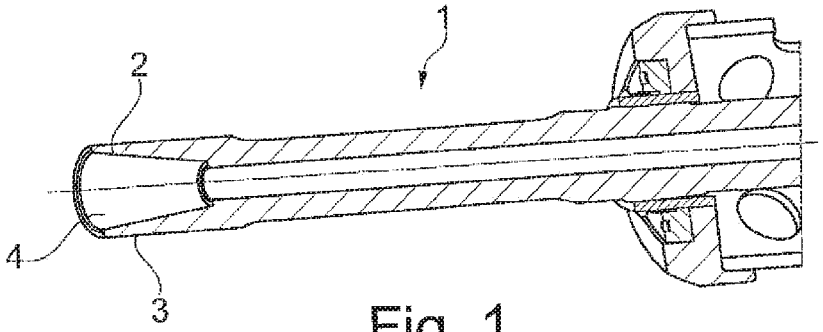
FIG. 1 shows a perspective sectional representation of a recoil intensifier.
Figure 3:
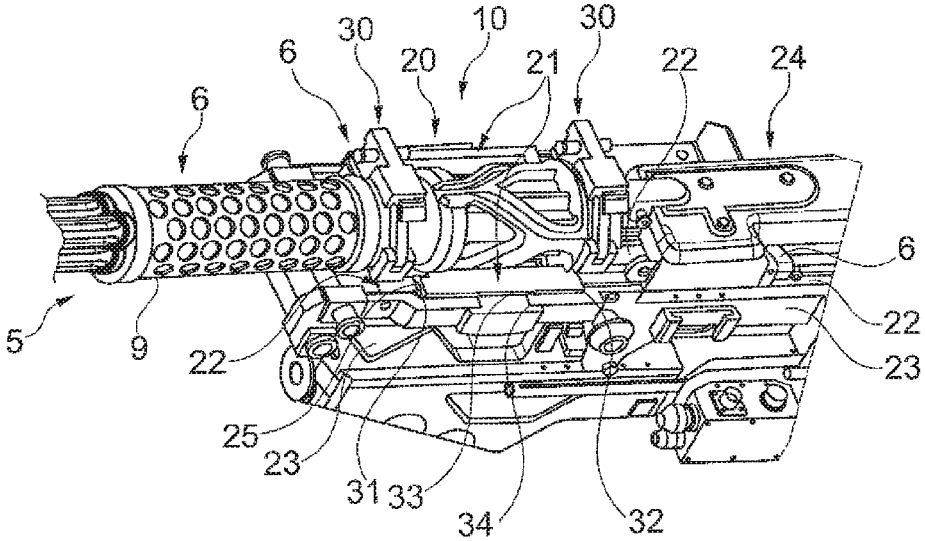
FIG. 3 shows the recoil intensifier as shown in FIG. 2 with a return damping device mounted in the weapon.

FIG. 1 shows in a perspective sectional representation the weapon barrel 1 of an externally powered weapon 10 partially represented in FIG. 3, such as a machine weapon or machine gun, with a recoil intensifier 2, into which the front end 3 of the weapon barrel 1 goes over, preferably without a transition. The recoil intensifier 2 may be formed in one part with the weapon barrel 1. The recoil intensifier 2 preferably has a simple funnel shape 4. Alternatively, the funnel-shaped recoil intensifier 2 may also be screwed onto the front end of the weapon barrel or be fastened in some other way in a manner similar to a muzzle brake.

Figure 2:
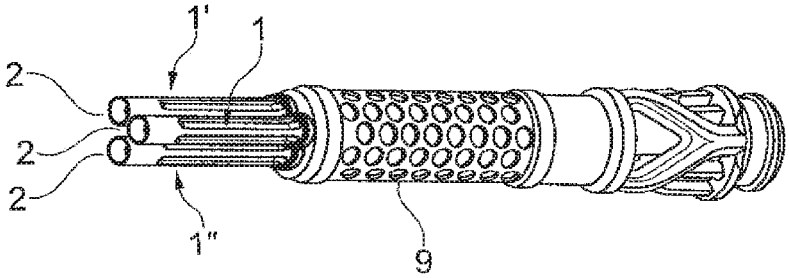
FIG. 2 shows a perspective representation of the recoil intensifier in one application.

In FIG. 2 a number of weapon barrels 1 are represented (barrel cluster 9), each with a recoil intensifier 2. The effect of intensifying the recoil is only provided by the system (weapon barrel 1, recoil intensifier 2) in the firing position of the machine gun 10, preferably by the system in the lower position 5.

The weapon 10 has for its part a weapon housing 22, which can be carrier-mounted in a weapon cradle 23 and allows an internal return of the returning masses 6 within the weapon cradle 23.

The way in which the recoil intensification functions in the case of the externally powered weapon 10 is as follows:

When a shot is fired, a momentum counter to the firing direction is exerted in a known way on the returning masses 6 of the weapon, such as the weapon barrel 1, the weapon housing 22, etc. This momentum is boosted, i.e. intensified, by the shape of the recoil intensifier 2, here by the funnel shape 4, at the front end 3 of the weapon barrel 1. The returning masses 6 thereby undergo an intensified return. By being intensified, this return of the weapon housing 22 generates a sufficiently strong and dependable signal to allow the function, and consequently the functional dependability, of the machine weapon 10 to be checked. This signal, which is preferably triggered mechanically by the returning masses 6 or the return of the weapon housing 22, is then used for example to count the number of shots. If necessary, an emergency stop function may also be activated. Furthermore, the initiation of further functions of an externally powered machine weapon 10 may also be based on this signal. In this case, the mechanical signal may also be converted into an electrical signal, for example by a switch for shot counting, etc., i.e. in a way corresponding to the further use of the signal.

In the case of this externally powered weapon, the recoil intensifier 2 serves as a functional part, i.e. as an intensifier part, for functional checking of the weapon 10 itself, not as an active part, as in the case of known recoil-operated automatic guns.

Represented in FIG. 3 is an internal return damping device 20, here for example with two return dampers 21, at the center of gravity of the returning masses 6. The return damping device 20 used here comprises two return dampers 21, formed of a housing for receiving a spring, for example a spiral spring (not represented any more specifically) and bolts 31, 32 attached on both sides to the end faces of the housing 33 as end points or contact bolts. These two bolts, the front bolt 31 and the rear bolt 32, are for their part preferably placed between steady rests 30 of a securing device of the weapon barrel/weapon barrels 1, 1', 1" (≙barrel cluster 9). The return dampers 21 are placed in clearances 34 in the weapon cradle 23 and fixedly integrated therein. They have a backlash 25 with respect to the weapon housing 22 (the steady rests 30). The weapon cradle 23 and also a feeder 24 are fixed in place with respect to the returning masses 6.

With firing and return, the weapon barrel 1 (with barrel cluster 9) and the weapon housing 22 with the securing device of the weapon barrel or barrels 1, 1', 1" are moved rearward, counter to the direction of firing. In this case, a sufficient displacement path of the weapon housing 22 is made possible or realized. The weapon housing 22 and the returning masses 6 are damped by the return dampers 21, which are fixedly incorporated in the cradle 23 and are struck by the steady rests 30 oscillating with the returning masses 6 during the recoil. In other words, seen in the direction of firing, the front steady rest 30 strikes the front ends of the return dampers 21 when the weapon housing 22 has traveled over a sufficient displacement path. The backlash 25 is in this case used up and displaced to the rear (counter to the direction of firing). As already described, with the return intensified by the recoil intensifier 2, the front steady rest 30 hits the front bolt 31 of the return damper 21. In addition to the damping, this can generate the signal that can be used for the functional testing of the weapon 10. When the returning masses 6, and consequently also the weapon housing 22, oscillate back in the direction of firing, the rear steady rest 30 strikes the rear bolt 32.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An externally powered weapon comprising:
an external drive that powers the weapon;
at least one weapon barrel;
a weapon housing; and
a recoil intensifier arranged at a front end of the weapon barrel for intensifying a return of returning masses of the weapon and for generating and intensifying a signal for follow-up functions of the weapon, the front end of the weapon barrel being a muzzle end of the weapon barrel.

2. The weapon as claimed in claim 1, wherein the recoil intensifier has a shape of a funnel.

3. The weapon as claimed in claim 1, wherein the signal is used for at least one of counting the number of shots or initiating an emergency stop function.

4. The weapon as claimed in claim 1, wherein the weapon barrel surrounds the recoil intensifier.

5. The weapon as claimed in claim 1, wherein the recoil intensifier is fastened to the weapon barrel.

6. The weapon as claimed in claim 1, wherein the mechanically intensified signal is converted into an electrical signal.

7. The weapon as claimed in claim 1, wherein an internal return damping device is incorporated.

8. The weapon as claimed in claim 7, wherein the internal return damping device comprises two return dampers at the center of gravity of the returning masses.

9. The weapon as claimed in claim 8, wherein a weapon cradle and also a feeder are fixed in place with respect to the returning masses.

10. The weapon as claimed in claim 1, wherein one of the follow-up functions is functional monitoring of the weapon.

11. The weapon as claimed in claim 8, wherein the weapon housing is part of the returning masses.

12. The weapon as claimed in claim 1, wherein the externally powered weapon is a machine weapon or a machine gun.

13. An externally powered weapon comprising:
at least one weapon barrel;
a weapon housing; and
a recoil intensifier arranged at a front end of the weapon barrel for intensifying a return of returning masses of the weapon and for generating and intensifying a signal for follow-up functions of the weapon, wherein the recoil intensifier is positioned inside of the front end of the weapon barrel, wherein the recoil intensifier is funnel-shaped such that a diameter of the recoil intensifier tapers in a direction from the front end of the weapon barrel towards the weapon housing, so that a first end of the recoil intensifier, that is aligned with a distal end of the weapon barrel at the front end thereof is wider than an opposing second end, and wherein the second end of the recoil intensifier directly contacts and is aligned with a projectile passage inside of the weapon barrel.

14. The weapon as claimed in claim 13, wherein the recoil intensifier is positioned entirely within the front end of the weapon barrel.

15. The weapon as claimed in claim 13, wherein a diameter of the second end of the recoil intensifier substantially corresponds to a diameter of the projectile passage to which the second end directly contacts.

16. An externally powered weapon comprising:

at least one weapon barrel;

a weapon housing; and a recoil intensifier arranged at a front end of the weapon barrel for intensifying a return of returning masses of the weapon and for generating and intensifying a signal for follow-up functions of the weapon, wherein an internal return damping device is incorporated, wherein the internal return damping device comprises two return dampers at the center of gravity of the returning masses, wherein a weapon cradle and also a feeder are fixed in place with respect to the returning masses, and wherein the two return dampers are fixedly integrated in the weapon cradle, wherein each of the two return dampers have a housing, the housing having a front bolt and a rear bolt, and wherein the front bolt and the rear bolt are struck by oscillation of the returning masses.

17. The weapon as claimed in claim 1, wherein the weapon barrel circumferentially surrounds an entirety of an external surface of the recoil intensifier.

* * * * *